United States Patent [19]

Ott et al.

[11] 4,340,265

[45] Jul. 20, 1982

[54] MULTI-COAXIAL/POWER PIN CONNECTOR ASSEMBLY HAVING INTEGRAL GROUND

[75] Inventors: Conrad L. Ott, Lake Grove; George E. Ris, East Northport, both of N.Y.

[73] Assignee: Automatic Connector, Inc., Commack, N.Y.

[21] Appl. No.: 146,022

[22] Filed: May 2, 1980

[51] Int. Cl.[3] ..... H01R 4/66; H01R 23/06

[52] U.S. Cl. ..... 339/14 R; 339/177 R

[58] Field of Search ..... 339/177 RF, 143 R, 75 M, 339/92 M, 14 RP

[56] References Cited

U.S. PATENT DOCUMENTS 3,128,138 4/1964 Noschese ..... 339/177 R X

*Primary Examiner*—Eugene F. Desmond

*Attorney, Agent, or Firm*—Berger & Palmer

[57] ABSTRACT

A multi-pin/coaxial assembly is disclosed in which an electrically conductive molded shell is employed which includes an integrally molded connector plate having apertures into which the outer conductors of the coaxial cables are inserted making electrical contact. Additionally, another aperture is provided integrally formed in the shell to which is attached a power ground lead thereby providing a common ground for both coaxial lines and power lead. Additionally, the assembly contains power leads which are insulated from the ground.

4 Claims, 6 Drawing Figures

MULTI-COAXIAL/POWER PIN CONNECTOR ASSEMBLY HAVING INTEGRAL GROUND

BACKGROUND OF THE INVENTION

This invention relates to coaxial cable connector assemblies, and more particularly, to a multi-pin/coaxial cable connector which also carries power leads.

Coaxial cables are formed of outer conductors adapted to be at ground with an insulated inner conductor. The effective grounding of the outer coaxial conductor is often a problem, especially where high frequency signals are carried. Additionally, sometimes there is a requirement to also carry power leads in the same connector in which the coaxial cables are connected, and the close proximity of coaxial cables to each other and/or to power leads often results in interference and cross-talk, thus deleteriously affecting the characteristics of the transmitted signals.

Prior attempts to positively ground multi-pin coaxial connectors are generally cumbersome and unsuccessful. These have included such designs in which the coaxial outer braided conductor is pig-tailed to the shell and also have included the provision of a separate ground plate connected at the connector interface. Such approaches are cumbersome, unwieldy, do not sufficiently reduce interference due to cross-talk, and present too/ many separate parts which require careful assembly. Where miniaturization is required, and a large number of coaxial cables and power lines are carried, prior art design approaches are unable to successfully meet the technical problems.

An object of this invention is to provide an improved multi-pin/coaxial cable connector assembly.

Another object of this invention is to provide such an assembly in which a positive ground is integral to the connector effecting an "ideal" RF coaxial interface.

Still another object of this invention is to provide such an assembly which is capable of handling or carrying a large number of coaxial cables and power leads simultaneously in the same connector.

Another object of this invention is to provide a highly compact coaxial cable connector carrying both coaxial cables and power lines.

Yet another object of this invention is to provide such a coaxial cable connector assembly which is efficient and inexpensive to manufacture.

Other objects, advantages and features of this invention will become more apparent from the following description.

SUMMARY OF THE INVENTION

In accordance with the principles of this invention, the above objects are accomplished by providing a multi-pin connector assembly having male and female members, with each of the male and female members comprising a shell which is molded from an electrically conductive material and which comprises a plurality of apertures through which the coaxial cables are inserted so that the outer conductor makes electrical ground with the shell. At least one of said connector panels also comprises an additional aperture through which a power lead is frictionally held which makes electrical contact with the shell and provides a positive, common ground for both coaxial and power connections.

DETAILED DESCRIPTION OF THE DRAWINGS

Figure 1:
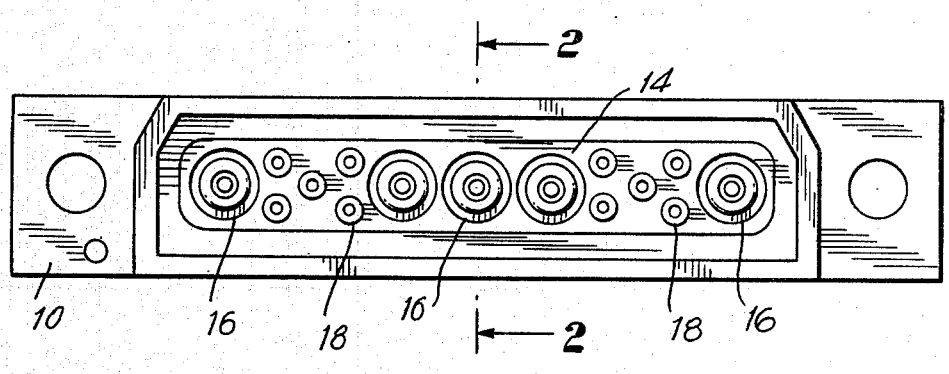
FIG. 1 PRIOR ART
FIG. 1 is an end view of a prior art female member of a multi-pin/coaxial cable connector.
Figure 2:
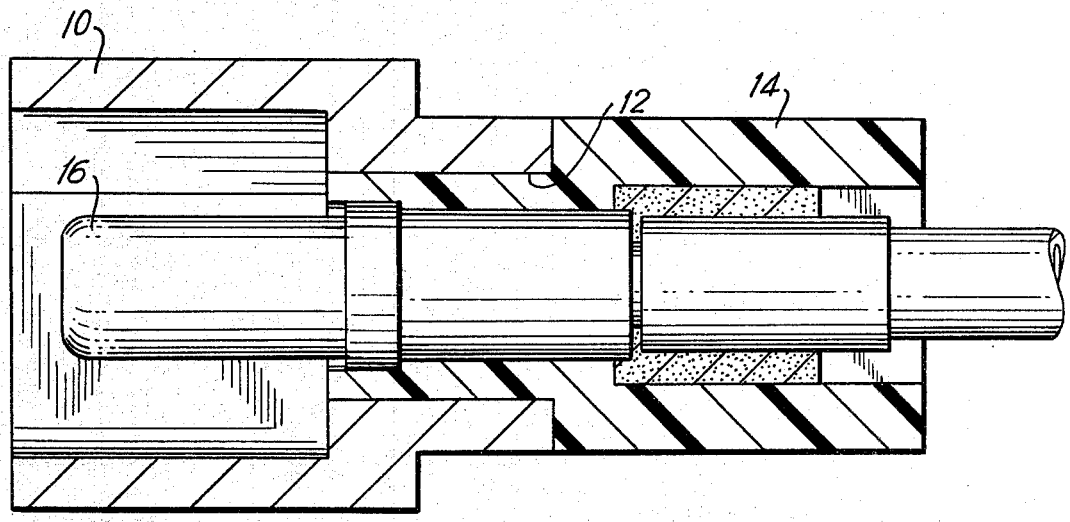
FIG. 2 PRIOR ART
FIG. 2 is a sectional view taken along lines 2—2 of FIG. 1 of the prior art connector.

FIG. 1 shows an end view of a prior art multi-pin female connector assembly manufactured by the assignee of the present patent application. FIGS. 1 and 2 illustrate the prior art and are set forth because of the similarity in outer configuration of the prior art multi-pin connector manufactured by the assignee in order to highlight the present invention. Referring to FIG. 1, there is shown a shell 10 formed of an electrically conductive material having an elongated aperture 12 formed therein, in which there is inserted an insulating insert 14 which is adapted to receive and carry a plurality of coaxial cables 16 and power leads 18. The insulating insert 14 is formed of a preformed rigid non-conductive material, and ensures that there is no electrical connection between the shell 10 and the outer conductors of the coaxial cable 16 and power leads 18.

Figure 3:
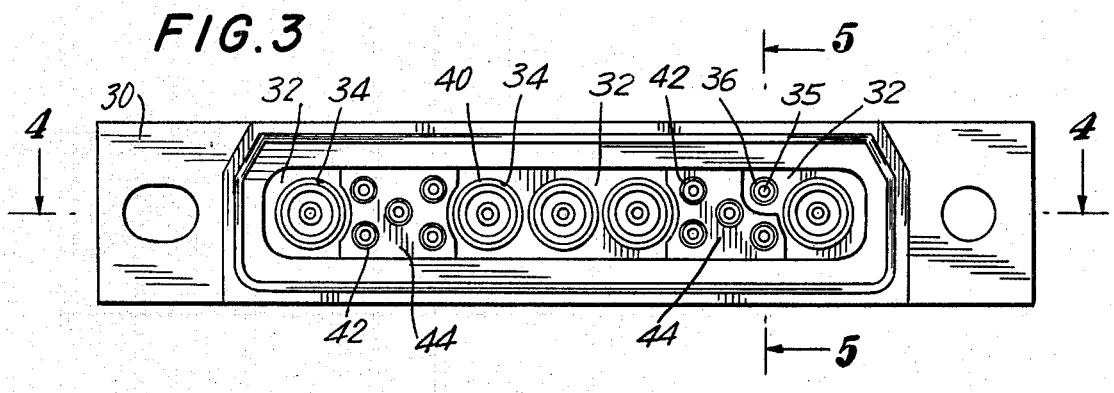
FIG. 3 is an end view of the female member of the present invention.
Figure 4:
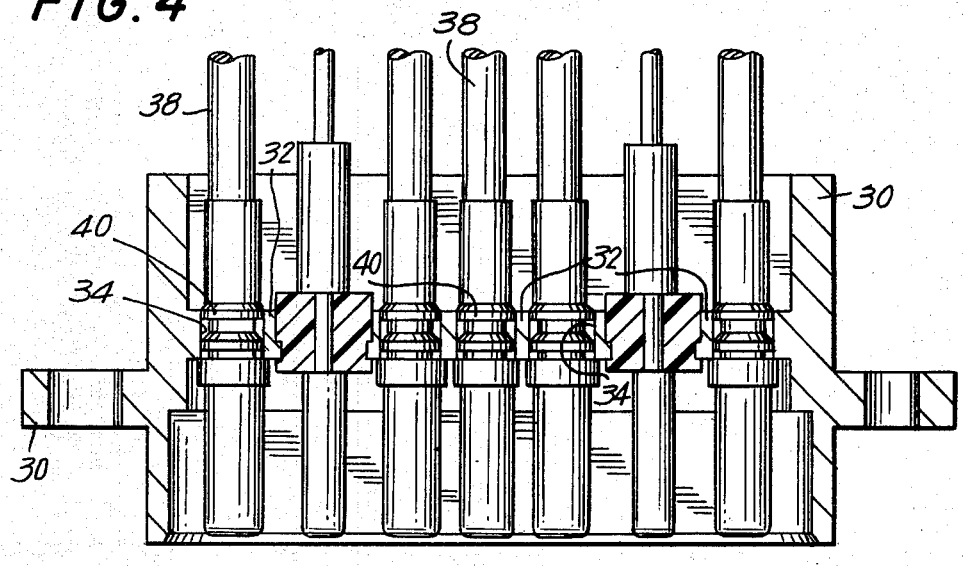
FIG. 4 is a cross-sectional view taken along the lines 4—4 of FIG. 3.
Figure 5:
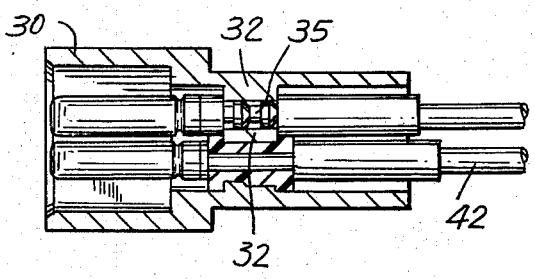
FIG. 5 is a sectional view taken along the lines 5—5 of FIG. 3.

The present invention is illustrated in FIGS. 3 through 5, and FIG. 3 shows an end view of the female member of the coaxial connector assembly. The cross-sectional view in FIG. 3 is generally similar to that of FIG. 1, and the differences relate to the provision for positive common grounding of all coaxial outer conductors and a power lead to the connector shell. The shell is illustrated as numeral 30 and is formed of a casting made from a metallic material, with the shell also including a connector panel 32 integrally formed with the shell, both being formed from electrically conductive material. The connector panel so integrally formed in the shell is provided with a plurality of apertures 34 as well as an additional aperture 36. Apertures 34 are adapted to frictionally receive and electrically connect the shell 30 with the outer conductors of the coaxial cables, while aperture 36 is adapted to frictionally engage one of the power leads to electrically connect that power lead to the shell thus providing a common ground for both coaxial outer conductors and one power lead.

FIGS. 4 and 5 illustrate in better detail the nature of the connector panel 32 which operates in conjunction with the coaxial cables and power line to effect positive, common grounding at the connector shell. In particular, the shell 30 extends generally in the direction of the coaxial cables 38, and the outer conductor 40 of the coaxial cable 38 frictionally fits into aperture 34 so as to provide an electrical connection between the outer conductor 40 and aperture 34 which is integrally connected to shell 30. Five such coaxial cables are provided. Additionally, the multi-pin connector female assembly of this invention is adapted to carry 10 power lines, with 9 of the power lines adapted to carry power, while one of the power lines is a ground lead. In particular, and with reference to FIG. 5, the shell 30 has aperture 36 adapted to frictionally engage power pin 35 so as to effect an electrical connection to the shell 30, while the other power conductors 42 are connected in the shell by means of insulating inserts 44 to electrically isolate the other power lines from the electrical ground integrally formed in the shell.

Although FIGS. 3 through 5 illustrate the female connector, it is understood that the male connector is merely the mirror image of the female, and an integrally formed connector plate is also formed in the male shell. Of course, in the male shell, the additional aperture for the ground lead is omitted, since the ground lead is positively connected to the shell in the female. Clearly, the provision of the aperture for carrying the positive ground to the shell could be formed in the connector plate formed in the male connector, so that aperture 36 would be omitted from the connector plate of female connector 31.

The present invention provides for a compact connector assembly in which a plurality of coaxial cables and power leads are simultaneously carried within the same shell, and the mating section of the shell has a cross-sectional size of approximately one inch wide by one-quarter inch high. This compact arrangement represents a significant advance in which the cross-talk and interference between adjacent lines is substantially eliminated by the positive ground connection to the shell through the molded and integrally formed connector plate.

Figure 6:
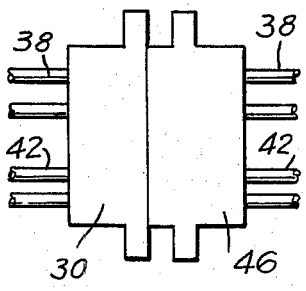
FIG. 6 is a plan view showing the male and female connector members connected together.

FIG. 6 shows the male plug member 30 connected to the female receptacle member 46.

PRIOR ART STATEMENT

In addition to the prior art identified as FIGS. 1 and 2 of the instant application, a prior art search was conducted and the following references were developed.

3,128,138—Noschese
3,513,433—Carroll
3,548,365—Barxer
3,852,700—Haws

The patents to Carroll and Barxer generally show conventional pigtail grounding for the outer coaxial conductor, which is identified as prior art in this application.

The patent to Noschese shows a spring 23 which surrounds the outer coaxial conductor and makes electrical contact with the conductor and the shell in order to achieve a potential grounding. There is no showing for an integrally formed aperture in which the outer conductor is adapted to frictionally fit and in which there is also provided an aperture to have direct connection to a ground.

The patent to Haws shows a ground plane 110 having a series of apertures, with selected one of the apertures being adapted to interface and connect with selected ones of the coaxial lines. This separate ground plane must be separately attached at the interface between the male and female portions of the connector, and represents an unwanted and undesirable additional element.

None of the patents show, suggest or disclose an integrally formed molded shell in which apertures are provided for direct connection to the outer coaxial conductor. Further, there is no showing nor suggestion of an integrally formed connector plate which directly and positively connects a power lead to the shell thereby providing a common ground for all coaxial outer conductors and a power lead, which reduces interference due to cross-talk.

What is claimed is:

1. A multi-coaxial/power pin connector assembly carrying coaxial cables and power leads comprising a molded male shell assembly formed of an electrically conductive material into which said coaxial cables and power leads are assembled to form a male plug, a molded female shell assembly formed of an electrically conductive material into which said coaxial cables and power leads are assembled to form a female receptacle into which said male plug is inserted, said molded male and female shells being in electrical contact with each other and each comprising an integral molded connector panel formed of said conductive material and having a plurality of apertures adapted to directly frictionally engage the outer conductors of said coaxial cables inserted in respective ones of said apertures to make electrical contact between the shell and outer conductors of said coaxial cables, wherein at least one of said molded connector panels comprises an additional aperture, and a common ground wire directly fitting into, frictionally engaging and making electrical contact with said additional aperture to directly connect said common ground with said coaxial outer conductors and to ground each of said shells.

2. The assembly according to claim 1, further comprising insulation inserts secured to said connector plates of said male and female shells, at least one of said power leads being connected to said insulation inserts to provide an electrical power path through said connector which is electrically insulated from said male and female shells.

3. A multi-pin connector assembly according to claim 1, wherein said grounded shell comprises a metallic material.

4. A multi-pin connector assembly according to claim 1, wherein said connector carries five coaxial cables and ten power leads and the cross-sectional size of said connector is approximately one inch wide by one-quarter inch high.

* * * * *